US005746684A

United States Patent [19]

Jordan

[11] Patent Number: 5,746,684

[45] Date of Patent: May 5, 1998

[54] FOUNDATION STAND AND METHOD OF USE

[76] Inventor: James L. Jordan, Box 40, Brandon, Vt. 05733

[21] Appl. No.: 759,477

[22] Filed: Dec. 5, 1996

[51] Int. Cl.[6] ..... A63B 22/08

[52] U.S. Cl. ..... 482/62; 482/57

[58] Field of Search ..... 482/4, 5, 57, 58, 482/62

[56] References Cited

U.S. PATENT DOCUMENTS

| | | | |
|---|---|---|---|
| 2,144,206 | 7/1939 | Thompson | 482/57 X |
| 5,016,870 | 5/1991 | Bulloch | 482/62 |
| 5,104,119 | 4/1992 | Lynch | 482/5 |
| 5,256,115 | 10/1993 | Scholder | 482/4 X |
| 5,299,992 | 4/1994 | Wikinson | 482/62 X |
| 5,342,262 | 8/1994 | Hansen | 482/62 |
| 5,476,441 | 12/1995 | Durfee | 434/112 X |
| 5,549,527 | 8/1996 | Yu | 482/57 |
| 5,643,146 | 7/1997 | Stark | 482/5 X |

*Primary Examiner*—Richard J. Apley
*Assistant Examiner*—William LaMarca
*Attorney, Agent, or Firm*—Eric R. Benson

[57] ABSTRACT

A rehabilitation and cross train exercise method and apparatus necessary to apply the method, utilizing a cycle ergometer while in a natural upright body stance isotonically exercising the lower extremities through a natural range of motion, at slow R.P.M.'s, working against a variable resistance, while simultaneously exercising the upper body musculature isometrically, by employing a multiple handhold apparatus and using a sequence of different handhold positions allowing exertion through a wide range of motion. The cardiovascular, aerobic and anaerobic conditioning and flexibility enhancing benefits that can be derived from this method and apparatus create a foundation upon which general physical and specific athletic performance and rehabilitative progress can be built.

7 Claims, 6 Drawing Sheets

34
32
33
37
35
38
6
27
42
23
24
29
25
26
40
39
25
41
43
43
38

FOUNDATION STAND AND METHOD OF USE

BACKGROUND OF THE INVENTION

1. Field of the Invention

The present invention relates to an exercise machine and method of using the exercise machine, and more particularly pertains to a variable resistance, medium to low R.P.M. ergometer and hand hold apparatus to facilitate a standing cycling motion and method of use that facilitates a comprehensive physical rehabilitation method and athletic training and cross-training method.

2. Description of the Prior Art

The use of standing exercise machines and ergometers in sports and athletic training is known in the prior art. For example, U.S. Pat. No. 3,563,541, which issued to Sanquist on Feb. 16, 1971, discloses a stationary exercise machine with a simple hand hold for balance to simulate jogging or running. Standing exercise machines are similarly disclosed in U.S. Pat. No. 4,659,075, which issued to Wilkinson on Apr. 21, 1987, (Device for simulation of climbing); U.S. Pat. No. 5,242,343, which issued to Miller on Sep. 7, 1993, (Stationary exercise device simulating a walking motion) As such, the basic concept of the standing exercise machine and its use are disclosed.

Similarly, U.S. Pat. No. 4,477,072, which issued to DeCloux on Oct. 16, 1984, discloses an apparatus that simulates stand-up hill climbing pedaling. An exercise bicycle is incorporated with the pedal apparatus which utilizes either a clutch and gear system or a locking ratchet system. U.S. Pat. No. 4,643,419, which issued to Hyde on Feb. 17, 1987, discloses a fixed exercise platform to be utilized in conjunction with either a fixed standup or sit-down cycling machine or any ordinary moveable cycling device. Also, U.S. Pat. No. 5,279,529, which issued to Eschenbach on Jan. 18, 1994, discloses an exercise apparatus designed to simulate uphill cycling engineered to eliminate dead center rotary crank problems. In effect these patents are illustrative of standing exercise machines that simulate stand-up hill climbing pedaling.

Also disclosed in the prior art of U.S. Pat. No. 5,242,343, which issued to Miller on Sep. 7, 1993; U.S. Pat. No. 5,403,255, which issued to Johnston on Apr. 4, 1995; U.S. Pat. No. 5,314,392, which issued to Hawkins on May 24, 1994; and U.S. Pat. No. 5,423,729, which issued to Eschenbach on Jun., 13, 1995, are standing-use exercise apparatus with various combinations of simple handholds and simple upper-body exercise devices.

While each of these prior art patents disclose standing exercise apparatuses and method which fulfill their respective particular objectives and requirements, and are most likely quite functional for their intended purposes, it will be noticed that none of the prior art cited disclose an apparatus and/or method that allow a user, either with or without medical supervision, to perform the specific functions of physical rehabilitation and athletic training or cross-training incorporating the use of specific muscles and muscle groups to at once maximize performance and potential benefit, but also to minimize the risk of injury (or further injury when used in rehabilitation). As such, there apparently still exists the need for new and improved standing exercise methods and apparatuses which are operable in a physical rehabilitation and athletic training setting which involve the incorporation of specific and targeted muscle groups of the body to maximize the benefits to the user and minimize the risks of injury from its use. In this respect, the present invention disclosed herein substantially fulfills this need.

SUMMARY OF THE INVENTION

In view of the foregoing limitations inherent in the known types of standing exercise machines and methods now present in the prior art, the present invention provides an apparatus and method of use of a standing exercise machine that has been designed by a medical doctor specializing in the treatment of sports injuries for use in a rehabilitation or athletic training or cross-training setting which are improvements which are patently distinct over similar devices and methods which may already be patented or commercially available. As such, the general purpose of the present invention, which will be described subsequently in greater detail, is to provide a medically designed apparatus and method of use that incorporates the muscles of the body in a natural range of motion directed at comprehensive physical rehabilitation for the injured or chronically ill, and a wide range of athletic training and cross-training while concomitantly minimizing the user's risk of injury while using the present invention. There are many additional novel features directed to solving problems not addressed in the prior art.

To attain this the present invention generally comprises an exercise program, and its detailed fundamental concepts, generating both crosstrain and rehabilitation applications and the technology needed to apply it.

Central to the methodology and design is the concept that a cycle ergometer, or similar pedal device, with an adjustable resistance capability, and with pedal straps that allows both hip flexion and extension against resistance, provides the most efficient and least stressful technology for exercising the lower extremities. However, this exercise modality, when employed in a conventional manner, while seated, provides little recruitment of pelvic, low back, thorax and upper extremity musculature or movement through their natural range of motion.

It has been well established in athletic terms that using a cycle ergometer while standing requires recruitment of much greater total body musculature and to more easily generate higher cardiovascular demand. Bicycle racers, when sprinting to a finish, are almost all standing for this is the power position.

From this understanding, there has emerged in the prior art patented technologies designed to be used in an upright bipedal fashion incorporating either cycle or stepper modalities. All of them emphasize the benefit of using their low impact stress designs to more efficiently exercise a large cross section of musculature with the resulting skeletal and cardiovascular benefits. However, none of the prior art has provided a design that provides exercise of the upper body through its complete natural range of motion while simultaneously exercising the lower body in the preferred upright bipedal mode.

The objective of this invention and method is to introduce an injury risk free program for developing or increasing the foundation of cardiovascular and skeletal function applicable to any human exercise or sport, and for providing a powerful rehabilitation tool facilitating recovery from a myriad of injuries and, when sustained, prevention from generating new ones.

Too often training or rehabilitation techniques and technologies designed to enhance the function and injury recovery of specific anatomical areas involve very little integrated function of the body as a whole. Human evolutionary bipedal adaptation makes it imperative to be strong and efficient in maintaining, and if injured, recovering full use of, the position in which we perform our most strenuous activities—standing upright.

Homo sapiens are the only primates devoted to bipedalism, ostensibly generating a much more efficient land based form of locomotion. The most significant structural difference between humans and our quadrupedal primate cousins is in the anatomical configuration of the pelvis and the muscles emanating from it. Though many quadrupedal primates can function in a bipedal mode it is not a position that can be maintained efficiently for long periods of time (analogous to our walking on our hands). For humans the pelvic musculature and structure is the most important single structure enabling bipedal posture and locomotion. These muscles are the largest and most powerful found in the body and are integral to the function of the upper and lower extremities working together.

Based upon the aforementioned absolutes regarding the human anatomy, the maximum return from the time investment spent working with any single methodology/technology is inherent in a method and apparatus which utilizes an upright weight bearing stance and the ability to exercise all body joints through a natural range of motion with minimal impact stress while easily transitioning through variable resistance with the upper resistance levels allowing maximal muscular and cardiovascular effort. Optimum crosstrain and rehabilitation techniques and technologies should, while addressing weaknesses or injury of certain anatomical areas maintain, whenever possible, a focus on the integrated function of the body as a unit.

There is inherent in the adaptational configuration of the human spine and pelvis an optimum upright carriage defined by a series of curves within the sagittal plane and segmented from the cervical through the sacral vertebrae. In conjunction with the flexed hips, knees and ankles, the spinal conformation and its controlling musculature, functions as a spring allowing for a range of balance positions and, when rigidly maintained, an efficient transfer of the kinetic energy generated in the upper extremities to aid in the function of the lower extremities. This is accomplished through the synchronous contraction of the linked, overlapping and layered musculature of the back, with their insertions as proximal as the cervical spine and upper arm, and with distal origins on the pelvic rim. Conditioning these muscle groups to maintain the optimal posture maximizes athletic function and enhances injury prevention and recovery.

This conditioning of optimal posture is especially significant for the lumbar spine considering that it is responsible for bearing the body's greatest axial load and has insertions from the body's most powerful muscle group, while also having broad intrinsic mobility. Maintaining the integrity of the lumbar curve while transferring the forces transmitted to it from the upper body, whether it be lifting a heavy load, swinging a club, or sprinting down a track, becomes simultaneously protective and performance enhancing. By more efficiently stabilizing the lumbar curve through the conditioning of the musculature of the back that support it there is a facilitation of muscle contraction and turn over speed of both the hip flexors and hip extensors allowing for the most effective stride length, their sum total defining speed. This is best illustrated in the performance of world class sprinters, the ultimate of which being Olympic Gold Medalist, Michael Johnson. Mr. Johnson's greatest advantage resides in his obvious strength in maintaining a pronounced upright posture which enhances and optimizes the biomechanical function of his lumbar-sacral anatomy.

This methodology/technology, hereinafter referred to as the Foundation Stand, strives to provide an integrated, balanced function between the upper and lower body whether being used for crosstrain or rehabilitation purposes. Because the relative strength and capacity to perform work over time is much greater for the lower body than for the upper body the design of any methodology/technology requiring the simultaneous use of both should account for this difference. One of the concepts upon which the Foundation Stand was developed is that the relative work effort required in contracting muscles isotonically (concentric/eccentric contractions) is significantly greater than when those same muscles are contracted isometrically. A design that allows the lower body to work isotonically while the upper body exercises isometrically would keep their relative work effort potential in balance.

It has long been recognized that a cycle ergometer provides a very efficient technology for enhancing cardiovascular conditioning and lower extremity strength and range of motion while imparting low levels of impact force into the joint compartments. However, sitting on a bicycle seat while using the ergometer eliminates the ability to utilize the full potential of the most powerful muscle groups of the body—those most responsible for balance, speed, strength and endurance and which emanate from the pelvis. In addition there is little use of the upper body musculature.

Standing up on a cycle ergometer immediately recruits the pelvic and upper body musculature increasing the potential force applied to the pedals and allowing the exerciser to push bigger gears, thereby increasing the power output. This translates into greater speed for a bicyclist and is the reason why racers are in an upright stance when sprinting to a finish or climbing a steep grade. However, because of this recruitment of total body musculature and the increased cardiovascular demand, over time this position becomes difficult to maintain. Therefore, any exercise methodology advocating an upright stance on a cycle ergometer should employ a technology that both maintains the balance of the upper and lower body working together within their respective exertional potential and a simple mechanism for adjusting the cardiovascular demand.

The upright stance on a cycle ergometer provides the basis for the Foundation Stand program. There are three other major components to the method that ensure a utilitarian function and the ability to maintain the exercise over time. Exercising at a slow rate of R.P.M. against variable resistance and associated with the cycle ergometer the use of the Foundation Stands multiple hand hold assembly.

One of the primary objectives of the Foundation Stand method and apparatus is to activate and exercise the upper body musculature simultaneously with the lower by the use of the hand hold assembly. However, full utilization of upper body musculature only occurs when the lower body is working against a resistance force that is greater than it can sustain aerobically, by itself, over time. By exercising at slow rates of R.P.M. against an easily adjusted resistance force it greatly enhances the ability to moderate the work effort, modulate both upper body contribution and cardiovascular effort, and transition from aerobic to anaerobic exercise, and back, with ease. Slow R.P.M. minimizes the impact stress, significantly diminishing the risk of overuse injuries and providing an environment in which pre-existing injuries can be rehabilitated.

The Foundation Stand's hand hold apparatus is specifically designed to allow the full range of motion of the upper body while exercising isometrically and in concert with the lower body exercising isotonically. The range of motion for the upper extremities and especially of the shoulder joint is greater than that of any other joints of the body. The Foundation Stand's hand hold apparatus and side rails are designed to allow the arms to generate power and contribute to the exercise process throughout their natural range of motion but in an incremental fashion, sequentially using the different hand hold positions; isometrically exercising all muscle groups in both agonistic and antagonistic function.

The rehabilitation, athletic training and crosstraining benefits of the Foundation Stand method and apparatus over the prior art are:

1. A utilitarian methodology and technology design. A methodology that is easily learned and applied. A technology which is comfortable, easy to use and adaptable to a range of body sizes and types.
2. The derivation of significant benefits from a small investment in time, in either the physical rehabilitation or athletic training and crosstraining usages.
3. Improved maintenance of, or increase in cardiovascular tone.
4. The ability to work aerobically, at anaerobic threshold or anaerobically and to easily transition from one to another.
5. Simultaneously exercising both agonistally and antagonistically across a larger cross section of skeletal musculature and working all joints through a natural range of motion against a constant force of applied resistance.
6. The utilization of a natural bipedal upright stance which simultaneously exercises the upper and lower body through a natural range of motion with the integrated action of the pelvic musculature.
7. The ability to deliberately isolate and focus on the conditioning of the musculature of the back to increase spine stabilization and further concentrate on the lumbar-sacral curve.
8. The maintenance or improvement of overall anatomic function (strength, flexibility, aerobic and anaerobic conditioning) with the ability to rehabilitate or enhance specific anatomic areas.
9. The ability to work through all, and emphasize any, sport specific balance position.
10. The design of a methodology/technology which provides a wide range of exertional potential allowing for low level function for those with minimal conditioning or with significant injury to the upper levels of exertion that those with maximum conditioning cannot exceed.
11. Minimal joint impact forces and low soft tissue stress influences that thereby limit the potential of inducing stress injuries or aggravating pre-existing ones.
12. The most beneficial environment for injury rehabilitation; by enhancing repair while increasing: strength; range of motion; and restoring an integrated function with the rest of the body regardless of the situs of the injury being rehabilitated.

The prior art does not involve an integrated design in either its design or use and as such have significant limitations which the Foundation Stand apparatus and method overcome. By way of illustration these limitations are:

1. Stationary bikes:
   a. Because the pelvis is supported by a seat on a stationary bike, the largest, strongest and most integrally important musculature is prevented from working at its full potential, which is used exclusively in either a rehabilitative or athletic training or crosstraining environment will likely result in injury directly or by the resultant disproportionality of muscle development.
   b. The stationary bike provides very little, if any, recruitment of the upper body musculature and a very limited ability to work through the upper body's natural range of motion. Many users of stationary bikes read while utilizing the equipment and thus eliminate even the potential of upper body involvement.
2. Spinning:
   a. This design does allow for standing thereby recruiting pelvic musculature and integrating upper and lower body function. However, there is a very limited ability to exercise the thorax and upper extremities through a natural range of motion.
   b. The high R.P.M. recommended for this use is significantly more stressful to joints and soft tissue structures and is difficult, if not impossible to maintain if one is injured.
   c. Spinning also involves prolonged standing while maintaining pronounced flexion at the waist which significantly stresses the lower back.
3. Cross country ski machines:
   a. Overall cross country ski machines are an excellent exercise apparatus requiring an upright stance and activating a large cross section of skeletal musculature, however, it is very difficult to learn the technique.
   b. The upper body works proportionally harder than the lower, contributing to increased incidence of fatigue and which ultimately hinders the lower body from working to its potential and thereby limits the cardiovascular and calorie expending benefits.
   c. These machines have a limited range of motion for both the upper and lower body involving almost no motion of the thorax and with the feet shuffling in the same horizontal plane, very limited rotational range of motion of the knee.
   d. The herky jerky starts and stops are a potential source of injury on these machines with a significant potential of hyperextension and ligament and tendon damage.
4. Stair climbers:
   a. Stair climbers utilize a limited recruitment of the upper body musculature. The hand holds on these machines are primarily designed to assist the user in maintaining their balance, but have provided a convenient means of supporting a users' weight thereby decreasing the benefits of use of the machine in the first instance.
   b. These machines invoke a very limited motion of the thorax.
   c. Stair climbers also have a very limited and abnormal range of motion of the lower body incorporating more up/down motion of the legs, rather than a normal rotational motion of the hips and knees.
   d. These machines also provide no ability to work the strongest muscle group of the body, the hip flexors, against a resistance.
5. Treadmills:
   a. Treadmills involve very high impact stresses of joints and soft tissue strictures.
   b. While utilizing these machines a person is generally unable to exercise the upper body against resistance or through a full range of motion. The draw pulleys and pull arms available on some of these machines are very limited in their involvement of the body's musculature and are not specifically designed to invoke total body exercise and movement directed at rehabilitation and athletic training and crosstraining.
6. Rowing machines:

a. These machines are difficult to learn and to operate. The pelvis is supported by a seat which virtually disengages the optimal use of pelvic musculature.

b. Like many other machines, rowers engage a disproportionate upper body requirement in its use.

7. Climbing machines (Versiclimber):

a. These machines have a limited range of motion of the upper and lower body working mostly in the vertical plane much like the stepping or stair climbers.

The Foundation Stand program is designed to provide an enhanced physiologic base upon which can be built a wide range of athletic or rehabilitation objectives and to supplement other training or rehabilitation modalities. However, because of its cardiovascular, generalized strength and flexibility enhancing potential, as a fitness tool it can be complete unto itself.

PRINCIPLES FOR THE FOUNDATION STAND APPARATUS AND METHOD

I. By requiring an upright stance on a cycle ergometer the Foundation Stand apparatus and method provides the following benefits over the prior art:

a. the Foundation Stand and method of use completely activates the function of the pelvic musculature and its integration with the upper and lower extremities.

b. it also recruits the use of the thorax and upper extremity musculature which the majority of the prior art does not.

c. it allows muscular conditioning through a wide range of different balance positions II. Unlike any prior art disclosures the Foundation Stand Apparatus and Method utilizes slow rates of R.P.M. (10–70 Revolutions per Minute) which is an improvement over the prior art by providing for:

a. a less stressful and, if injured, less painful form of exercise or rehabilitation because the joints are being required to move through its range of motion slowly which reduces the loading stress of the tendons.

b. concentration on specific muscle groups and their action thereby ensuring full contraction and a joint's full range of motion.

c. an easier means of sustaining the effort required to work against higher levels of resistance, which enures a substantially greater benefit than the prior art because it is within these upper levels of resistance that the upper body is most effectively incorporated into the exercise.

d. an easier method to change the upper body positioning by moving from one handhold position to another in a deliberate, medically designed manner.

e. for more effective concentration on proper breathing techniques, with the concomitant benefit of more completely conditioning the respiratory musculature and ensuring adequate ventilation necessary to sustain the exercise.

f. an excellent supplementation to higher R.P.M. exercise by providing a base fitness level to sustain the higher R.P.M. without injury or fatigue.

g. a variable resistance ergometer that is easily adjusted, which in turn provides an opportunity to enhance the slow R.P.M. and allow for a simple interchange between aerobic and anaerobic effort and allowing a user to more effectively gauge and maintain pace than any of the prior art disclosures.

III. Rehabilitation or athletic training or crosstraining while standing on a variable resistance ergometer allows for immediate exercise performance at a greater resistance setting than if seated by providing:

a. the gravitational effect of the increased body weight on the downstroke and the recruitment of the upper body in more efficiently assisting in the exercise.

b. requiring upper levels of resistance greater than the lower body can sustain by itself, over time, to fully integrate the upper body in sharing the workload.

c. a method where as the resistance is increased the work required of the upper body musculature increases with a direct proportionality to that of the lower in order to turn the crank of the ergometer. This natural balance between the various parts of the body's musculature is not achieved in any of the disclosed prior art.

d. that because the higher the resistance setting for any maintained R.P.M. the greater the work effort. Therefore, it is possible at a set R.P.M. to interchangeably exercise aerobically, at anaerobic threshold and anaerobically by simply varying the Foundation Stand apparatus level of resistance.

e. that the upper levels of resistance chosen to be worked against by the athlete or rehabilitation supervisor will vary depending upon body weight, strength, conditioning, the sport specific objectives of the exerciser and the presence or absence of preexisting injuries.

f. that at the beginning of any exercise session there should always be an initial warm-up combining both low R.P.M. and low levels of resistance.

g. that at the end of each exercise session there should be a warm-down once again combining low R.P.M. and low levels of resistance.

h. that the Foundation Stand Apparatus and method be used as a warm-up and warm-down associated with any other form of exercise.

IV. By utilizing the Foundation Stand's hand hold apparatus across the complete range of hand hold options this apparatus and method allows the muscles and joints of the upper body to isometrically exercise through their natural range of motion, and in both agonistic and antagonistic fashion. As one leg pushes down against pedal resistance the ipsilateral arm pulls up, in or down depending on its position along the hand hold apparatus, and the contralateral arm will exert the opposite force in order to stabilize the body. At upper levels of resistance this ensures activating all muscle groups and their inherent function. The Foundation Stand Apparatus and method of use are superior to the prior art in that:

a. even though there may be certain sport specific hand hold settings of the prior art that would be emphasized to improve sport specific function (or positions emphasized for reasons related to rehabilitation) it is important, and an object of this invention, to work through them all to maximize flexibility, range of motion and injury prevention by:

1. sequentially progressing from the various hand positions of the lower hand hold apparatus to the positions of the upper hand hold apparatus which will gradually move the thorax from a pronounced flexion into its full extension and the shoulders from extension into its flexion.

2. progressing from the inner hand hold positions to the outer of either the lower or upper hand hold apparatus changes the position of the arms from relative adduction to abduction further directing a work load to specific musculature to incorporate those muscles into a true total body exercise or rehabilitation.

3. using the hand hold extensions for both the lower and upper handhold apparatus allows the shoulders to be positioned in either internalor external rotation; the forearms in pronation or supination; the wrists in flexion or extension, a feature which is absent from any of the prior art disclosures.

b. it has the ability to utilize the various hand hold positions with the upper extremities in either symmetry (using the same hand hold position on both sides of either the upper or lower assembly) or asymmetrically (i.e., (L) shoulder flexed, abducted and externally rotated with the (R) shoulder extended, adducted and internally rotated). The Foundation Stands' hand hold apparatus associated with the variable positioning of the lower body provides a virtually infinite variety of different body position combinations, including upper body angulation (lateral flexion) and the capacity for exercising pelvic and thoracic rotational musculature and therefore simulate sport specific body positioning and conditioning or rehabilitation. This is especially beneficial for positions (i.e., angulation of skiing, snowboarding, etc.) that are sustained for long periods of time. Unlike the prior art The Foundation Stands' hand hold apparatus and method of use also allow for exercising in certain transient rotational power positions that are part of a range of motion required in certain sport specific activities (i.e., cutting to effect directional change when running while playing football, soccer, basketball, etc.). The utilization of asymmetric positions facilitated by this invention and method can be used to enhance the power and flexibility involved in stationary rotational activities (i.e., swinging a golf club, tennis racket or baseball bat, etc.), as well as simulating the different motion positions required in swinging the arms (running, cross country skiing).

c. the hand hold apparatus is an integral feature to the rehabilitation capabilities of the Foundation Stand and method of use because it:

1. allows subtle or pronounced adjustment to upper and lower body flexion, extension and angulation to enhance positions of comfort without risk of injury or causing further complications with existing injuries.
2. fine tunes the body positions to promote the function of particular musculature or parts of the body or to avoid full use of specific areas of injury.
3. utilizes the upper hand hold positions to pull up, assisting hip flexion and diminishing the load on the lower back and lower extremities.
4. has the ability to maintain a limited range of motion of an injured upper extremity while maintaining a full range of motion of the other parts of the body.

SPECIFIC FOUNDATION STAND APPARATUS AND METHOD OF USE GUIDELINES

As for any other form of exercise, the benefits derived from this invention and method of use have a direct relationship to the frequency of its use and application. Because of the extremely low risk of developing a stress injury related to the use of this invention and method and the protective value in helping prevent injuries from other exercise modalities this invention can and should be used frequently, but, because of its recruitment of total body musculature the time required to achieve significant cardiovascular and skeletal benefits is small. Unlike the prior art which requires substantially more time than the Foundation Stand apparatus and method to achieve the goals of rehabilitation, athletic training and/or crosstraining, this invention and method requires significantly less time by providing for:

I. Frequent use a. peak results are obtained using the Foundation Stand apparatus and method 4–6 times a week, although virtually no risk of injury would result using this invention and method as often as 7 days a week, however, benefits from using this invention will be realized even with occasional or less frequent use;

b. use of the Foundation Stand apparatus and method as warm-up and warm-down before and after any other exercise modality especially if it involves impact stresses:

1. the Foundation Stand apparatus and method provide a gentle, thorough, full range of motion program that can be easily gauged to any level of exertion desired before proceeding with the primary exercise activity;
2. warm-down benefits in general are poorly utilized in most exercisers, however, the Foundation Stand apparatus and method will greatly enhance the recovery process by allowing gentle muscle contraction in a full range of motion speeding lactic acid removal and allowing the joints to move non-stressfully through their range of motion.

II. Time Requirement

The benefits derived from the Foundation Stand apparatus and method are directly proportional to the time invested but are also related to the levels of resistance exercised against. The stress/injury resistance and full body benefits of this invention and method are superior to the prior art in its application and use by providing for:

a. a recommended use of 20 minutes a day if the apparatus and method are not being used in conjunction with another exercise activity, and the user:

1. utilizes a conventional target pulse rate protocol; and
2. may split the 20 minute recommendation by dividing it into two 10 minute sessions if desired.

b. use of the apparatus and method in conjunction with another exercise modality wherein the user:

1. begins with a 5–10 minute warm-up using the Foundation Stand apparatus and method before exercise; and
2. ends with a 5–10 minute warm-down using the Foundation Stand apparatus and method after exercise.

It may be desired to add additional intense effort utilizing the Foundation Stand apparatus and method after completing the primary exercise but it should still include a warm-down period when finished in either case.

c. usages of 30 minutes or greater of the Foundation Stand apparatus and method for at least once a week, whether using the Foundation Stand apparatus and method alone or in combination with other exercise III. Slow R.P.M. (10–70 revolutions per minute)

In order to develop the work load upon the body's musculature in a methodical full body modality without risk of injury, or exacerbation of an existing injury, it is important to stay within this range (10 to 70 R.P.M.) because:

a. higher resistance settings will allow the user at slower R.P.M. to reach various aerobic and metabolic thresholds in drastically less time, and in a much safer manner, than the prior art; and b. once the Foundation Stand apparatus and method has been used consistently to develop a fitness threshold a user may work at a higher R.P.M., but only if there are no pre-existing injuries, because the higher the R.P.M. the greater the risk of developing a stress or overuse injury.

IV. Variable Resistance

The ability of the Foundation Stand apparatus and method to be utilized with variable resistance greatly enhances the object of this invention by:

a. always beginning each workout at both a low R.P.M. (10–70) and low levels of resistance;

b. maintaining the narrow R.P.M. (10–70) range and gradually increasing resistance to desired upper levels of resistance which are necessary to fully activate the contribution of the upper body musculature;

c. providing peak aerobic and metabolic benefits as the resistance is increased while maintaining a constant range of R.P.M. (10–70) the exercise mode gradually transitions from aerobic-anaerobic to threshold-anaerobic work; and e. adequate warm-down periods to allow sufficient time for recovery of sustained threshold-anaerobically exercised musculature before exercising at sustained anaerobic levels again.

V. Hand hold Apparatus

The Foundation Stand apparatus and method integrates an incremental and systematic use of all the hand hold positions and moves the upper body through a complete range of motion. The hand hold of the Foundation Stand apparatus and method may be used symmetrically and asymmetrically to fine tune desired body positions by a user independently or under medical supervision in a rehabilitation environment.

Sport Specific Applications of The Foundation Program

The Foundation Stand apparatus and method has been designed to enhance cardiovascular conditioning while increasing flexibility as well as aerobic and anaerobic function and will improve performance and provide a measure of injury protection for any athletic endeavor. By way of example of the sports specific benefits this invention and method incorporate, the following sports applications are:

I. Sports whose exercise components are closely aligned to the Foundation Stand apparatus and method:

A. Skiing 1. the range of body positions while on the Foundation Stand apparatus and method closely mimic those of skiing, i.e. hands forward while flexed at the shoulders, waist and knees;

2. skiing requires prolonged contractions of both upper and lower body musculature while fully activating the strongest muscle groups of the pelvis, abdomen, lower back and upper legs with a slow rate of turnover from one side to another which is analogous to slow R.P.M. (10–70) incorporated into the Foundation Stand apparatus and method;

3. skiing and the Foundation Stand apparatus and method both require holding the upper body relatively quiet while dynamically exercising the lower body;

4. the hand hold positions of the Foundation Stand apparatus and method, and the ability to use them asymmetrically, allow for exact reproduction by a user of the skiing angulation position of both the upper and lower body and for strengthening the rotational musculature that provides it; and 5. the Foundation Stand apparatus and method is the best dry land conditioning program to simulate and enhance the specific exercise requirements of skiing by providing peak results with no risk of injury or injury enhancement B. Snowboarding, skateboarding, rollerblading and speed skating all benefit from the attributes generated from the Foundation program for reasons analogous to those of skiing.

II. Sports for whom performance is enhanced by developing a strong base of physical fitness utilizing the Foundation Stand apparatus and method:

A. Bicycling 1. the power position when bicycling is out of saddle standing which more efficiently recruits the pelvic and upper body in the exercise and is the basis for the Foundation Stand apparatus and method. Since this is the most skeletally demanding and cardiovascularly taxing requirement of bicycling it is axiomatic that enhancing the ability to perform in this position would contribute to overall improvement;

2. using the Foundation Stand apparatus and method hand hold apparatus to exercise through different positions of back and pelvis flexion, extension and angulation is not possible on a bicycle, and will help avoid the overuse stress influences prevalent in bicycling which are invoked when maintaining pronounced back flexion over prolonged periods of time;

3. the Foundation Stand apparatus and method provides injury prevention and recovery of the bicycling stress influences related to leg length discrepancies which are aggravated by the fixed distance between the bicycle seat and the pedals and which are eliminated by standing on the pedals of the Foundation Stand apparatus and method which allow for upper body and pelvis compensation for these anomalies which all to often lead to injury and chronic pain;

B. Running (including all sports involving running as their foundation)

The Foundation Stand apparatus and method initially evolved as a method for recovering from a running injury. Standing erect on a cycle ergometer at slow R.P.M. allows the lower body to work through a running range of motion without the impact stress and heel strike associated with sports activities involved in running. The hand hold apparatus of the Foundation Stand apparatus and method allows the upper body to exercise isometrically within an intensity that is directly proportional to that of the lower body and analogous to the total body effort derived from running. The Foundation Stand apparatus and method can be utilized in a comprehensive running training or maintenance program by:

1. maintaining slow R.P.M. (10–70) on the Foundation Stand apparatus and method the running musculature is exercised in a deliberate contraction that minimizes joint, tendon and ligament inflammation and augments muscle strength of the critical muscles involved in running and promotes injury recovery when rehabilitating from a running, or other, injury;

2. providing for a low intensity warm-up before running and recovery warm-down after;

3. providing for a high intensity exercise regimen that allows sustained effort at anaerobic threshold and augmenting the anaerobic strength required in hill running and sprinting while minimizing the risk often associated with high intensity training;

4. using the hand hold apparatus of the Foundation Stand apparatus and method and its variable positions permits a user to maintain a more natural upright stance that can mimic any running position and by using asymmetrical hand hold positions of this invention a user can exercise in stages through a swinging arm motion analogous to that of running;

5. simulating a running technique with the Foundation Stand apparatus and method a user can augment training without the noxious influences and injuries associated with leg length discrepancy or stress imbalance that comes with running the side of a canted road, further strengthening the user to prevent such injuries when engaged in running under these adverse conditions; and 6. rehabilitating running induced stress or overuse injuries while maintaining muscular strength and endurance in a running specific posture and natural range of motion.

Rehabilitation Applications of The Foundation Program

When injured the optimum result of any rehabilitation program is the return to full function at a level equal to the performance abilities prior to the injury. Once recovered, a return to training should maintain the rehabilitation influences that allowed it to resume as a minimum component. The design of the Foundation Stand apparatus and method allows an injured person (athlete or not) to participate in a rehabilitation program that involves a protected exercise regimen in which the area of injury maintains an integrated function with the rest of the body, and in a natural upright, weight bearing stance. The combination of low R.P.M. (10–70) with the variable resistance of the Foundation Stand apparatus and method together with the use its multiple hand hold apparatus provides a virtually infinite variety of body positions, which in turn enhances the ability to find a relatively comfortable range of motion in which to maintain the exercise and rehabilitation influence of almost any injured area. The Foundation Stand apparatus and method is an effective rehabilitation tool for:

I. Upper Extremity, Thorax, Back and Abdomen Injuries

All musculature of the upper body is activated when both arms are holding onto the hand hold apparatus of this invention and as the crank is turned through one complete revolution around its axis there is both agonistic and antagonistic function required. Therefore, regardless of which hand hold positions are used, isometric toning of all upper body muscle groups occur. The isometric mode of the upper body while using the Foundation Stand apparatus and method induces little motion of the upper body joints until there is a change to a different hand hold position. Unless the injury being rehabilitated has instability associated with simple muscular contraction, the multiple hand hold apparatus of this invention will provide a range of position options for exercising the injured area even if it has a limited range of motion. It is possible to use the Foundation Stand apparatus and method with one arm completely inactivated in a sling by simply employing lower resistance settings and thereby maintaining cardiovascular conditioning together with non-injured muscle and joint strength and their flexibility. It is now possible with this invention, at low resistance settings, to maintain a low to medium level of exercise intensity primarily involving the lower body with only the light touch of just one arm needed to maintain balance. This aspect of the Foundation Stand apparatus and method provide for the user's ability to achieve significant exercise benefits even if both upper extremities have significant injuries. By way of further isolation of rehabilitative effects, the Foundation Stand apparatus and method allows work on:

A. shoulder rehabilitation of injuries to the shoulder which often result in the limiting of any or all of its various rotational motions, i.e. flexion/extension; abduction/adduction; internal/external rotation; circumduction. The hand hold apparatus of this invention provides options not present with the prior art to accommodate almost any of the shoulder's range of motion positions which allow the shoulder to exercise isometrically and maintain a comfort range. It becomes a simple matter of systematically but gradually improving the range of motion by implementing a greater range of hand hold positions until ultimately there are no restrictions to motion;

B. forearm, elbow, and wrist structures have a much less inherent motion than the shoulder, i.e. pronation/supination; flexion/extension, however, the approach to rehabilitate is essentially the same as the shoulder. The multiple hand holds of the Foundation Stand apparatus and method allows a user to find a position or range of motion that can be exercised with comfort within an isometric muscle and by changing hand holds and positions a user may gradually and safely increase to a full range of motion;

C. thorax injuries are among the most difficult impediment to maintaining an exercise or rehabilitation program because injuries involving the thorax transmit pain from the forces of impact and upper extremity motion involved in traditional exercise or physical rehabilitation, however, the Foundation Stand apparatus and method effectively eliminates this problem, while allowing an integrated exercise function with the rest of the body. Once again, using the options provided by the hand hold apparatus it is possible to fine tune the positions of comfort, and gradually increasing the range of motion as the basal fitness level is increased and the malady is rehabilitated.

II. Lower Body

The Foundation Stand apparatus and method requires that the lower body exercise isotonically (concentric and eccentric contraction) through a natural range of motion. However, at low R.P.M. (10–70) and initially low levels of resistance, even severe injuries to the powerful musculature of the lower body areas can effectively be rehabilitated even early in the post injury phase. In addition, the Foundation Stand apparatus and method multiple hand hold apparatus offers a full spectrum of options for displacing some of the down force otherwise applied to the lower body joints which range from the use of the side rails of the multiple hand hold apparatus to push a proportion of body weight up, to the use of the overhead hand hold positions for pulling the body weight up. The Foundation Stand apparatus and method can be used to effectively rehabilitate on a total lower body protocol or with respect to specific areas such as:

A. lower back and abdominal injuries are treated in a risk free environment with the Foundation Stand apparatus and method use of low R.P.M. (10–70) and low impact features combined with the hand hold apparatus which was specifically designed to provide an option to exercise in any position of back flexion and extension and the ability to displace upper body weight down-force by pushing down or pulling up. This makes the Foundation Stand apparatus and method a versatile invention for applying early rehabilitative influences to lower back injuries while maintaining overall conditioning. Prior art and methods do not provide for a means of maintaining broad benefit through safe aerobic and metabolic threshold exercise while simultaneously rehabilitating the user.

B. the hips and knees benefit from the Foundation Stand apparatus and method of rehabilitative influences in a similar manner as described above. In addition the optimal design of this invention includes an adjustable crankshaft length of the pedaling device that could change the stroke circumference around the crankshaft axis and by shortening the crankshaft length, accommodate any initial restriction in range of motion of either the hip or knee. Conversely, by increasing the crankshaft length incrementally over time the invention would gradually increase the range of motion of these joints. As with the lower back the hand hold apparatus provides options to displace upper body weight and assist an injured lower extremity in maintaining the stroke cycle.

C. ankle injuries may also be rehabilitated by using the clips that attach the foot to the crank pedal it is thereby easier to work a full range of motion around the ankle joint and emphasize or avoid certain positions (dorsi flexion, plantar flexion) depending on the phase of injury recovery.

III. The Foundation program can be used for a broad range of rehabilitative purposes including A. Post Operative Recovery:
1. Upper and lower extremity injury repair; and
2. General surgery of the thorax or abdomen;

B. Soft tissue injury recovery:
1. Ligament sprains;
2. Muscle and tendon strains and contusions;
3. Joint bursitis;
4. Patello-femoral syndrome;
5. Knee meniscus irritation and injury; and
6. Severe partial muscle or tendon tears.

C. Bone Injures:
1. Contusions; and
2. Stable fractures including epiphyseal injuries;

D. Post operative rehabilitation of joint replacement.

E. Cardiac Rehabilitation foundation program may provide the best exercise modality to easily adjust cardiovascular exertion.

Peripheral Application of Foundation Stand apparatus and method or its Components The Foundation Stand apparatus and method has a multitude of applications in areas related to health and fitness. These improvements on existing art, areas of practice and health benefits are:

I. Cardiac Stress Test:

a. the Foundation Stand apparatus and method can easily adjust cardiovascular exertion in a manner far quicker and safer than prior art; and b. because this invention incorporates all skeletal muscles, it is easier to achieve the desired cardiovascular levels without the patient first complaining of leg fatigue, which is a common problem with both the treadmill and exercise bike methods of stress testing.

II. Using the hand hold apparatus of the Foundation Stand apparatus and method with other exercise modalities will improve the upper body contribution to the exercise with these devices, such as: a. Stationary bikes; b. Stair clambers; and c. Treadmills.

III. An upright bicycle with a version of the hand hold apparatus allowing the body to maintain an upright stance while cycling outside will similarly increase the aerobic and metabolic benefits of cycling.

IV. Combining within a single frame the multiple hand hold apparatus of the Foundation Stand apparatus and method with a rear wheel resistance ergometer on which a conventional bicycle is placed provides an effective and inexpensive manner in which to own and use this invention at home.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention, method and apparatus, is not limited in its application to the details of construction and to the arrangements of the components set forth in the following description or illustrated in the drawings. The invention, method and apparatus, is capable of other embodiments and of being practiced and carried out in various ways. Also, it is to be understood that the phraseology and terminology employed herein are for the purpose of description and should not be regarded as limiting in any way the scope of this invention or claims made herein.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions and methods insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the present invention to provide a physical rehabilitation and sports training/cross training apparatus and method of use thereof which has many of the advantages of the standing cycle ergometers and exercise apparatuses mentioned heretofore and many novel features that result in a physical rehabilitation and sports training/cross training apparatus and method of use which are not anticipated, rendered obvious, suggested, or even implied by any of the prior art standing cycle ergometers and exercise apparatuses, either alone or in any combination thereof.

It is another object of the present invention to provide a new physical rehabilitation and sports training/cross training apparatus and method of use which may be easily and efficiently manufactured, taught and marketed.

It is a further object of the present invention to provide a new physical rehabilitation and sports training/cross training apparatus and method of use which is of a durable and reliable construction and method.

An even further object of the present invention is to provide a physical rehabilitation and sports training/cross training apparatus and method of use which is susceptible of a low cost of manufacture with regard to both materials and labor, and which accordingly is then susceptible of low prices of sale to the consuming public, thereby making such physical rehabilitation and sports training/cross training apparatus and method of use economically available to the buying public.

Still yet another object of the present invention is to provide a physical rehabilitation and sports training/cross training apparatus and method of use which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other that those set forth above will become apparent when consideration is given to the following detailed description thereof. Such description makes reference to the annexed drawings wherein.

DESCRIPTION OF PREFERRED EMBODIMENTS

Figure 2:
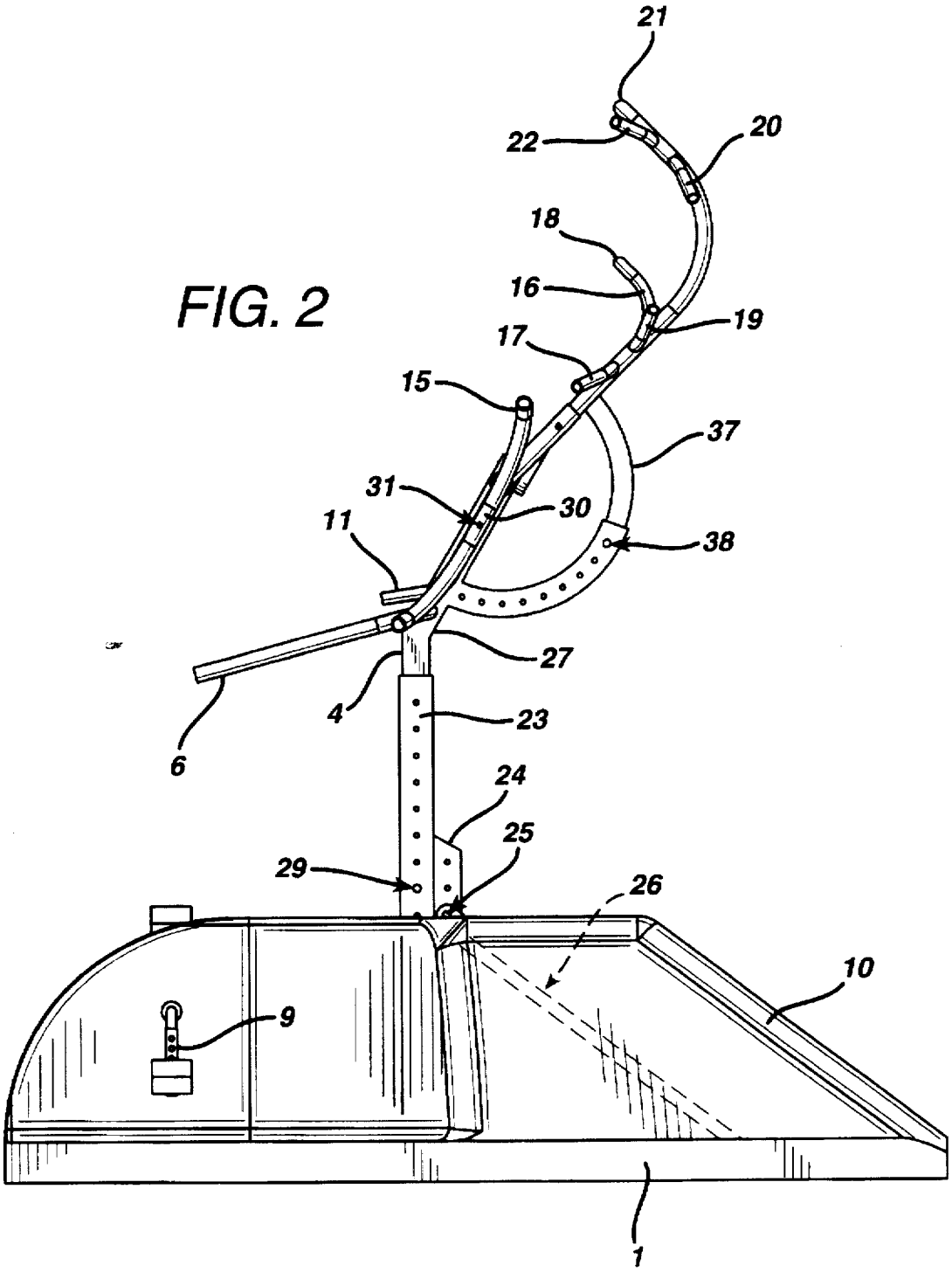
FIG. 2 is a right side elevation view of the apparatus in FIG. 1.
Figure 3:
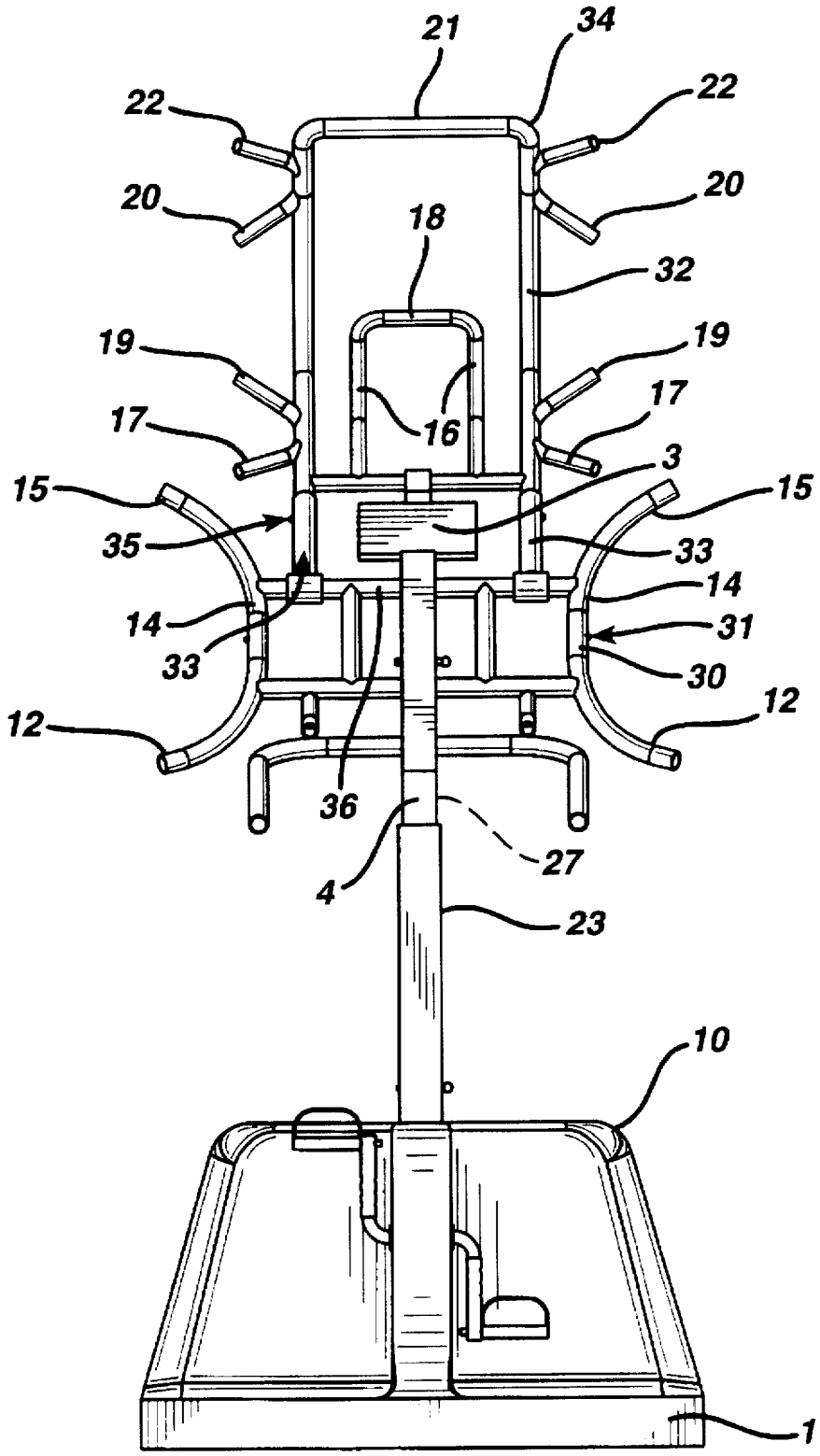
FIG. 3 is a rear elevation view of the apparatus in FIG. 1.
Figure 4:
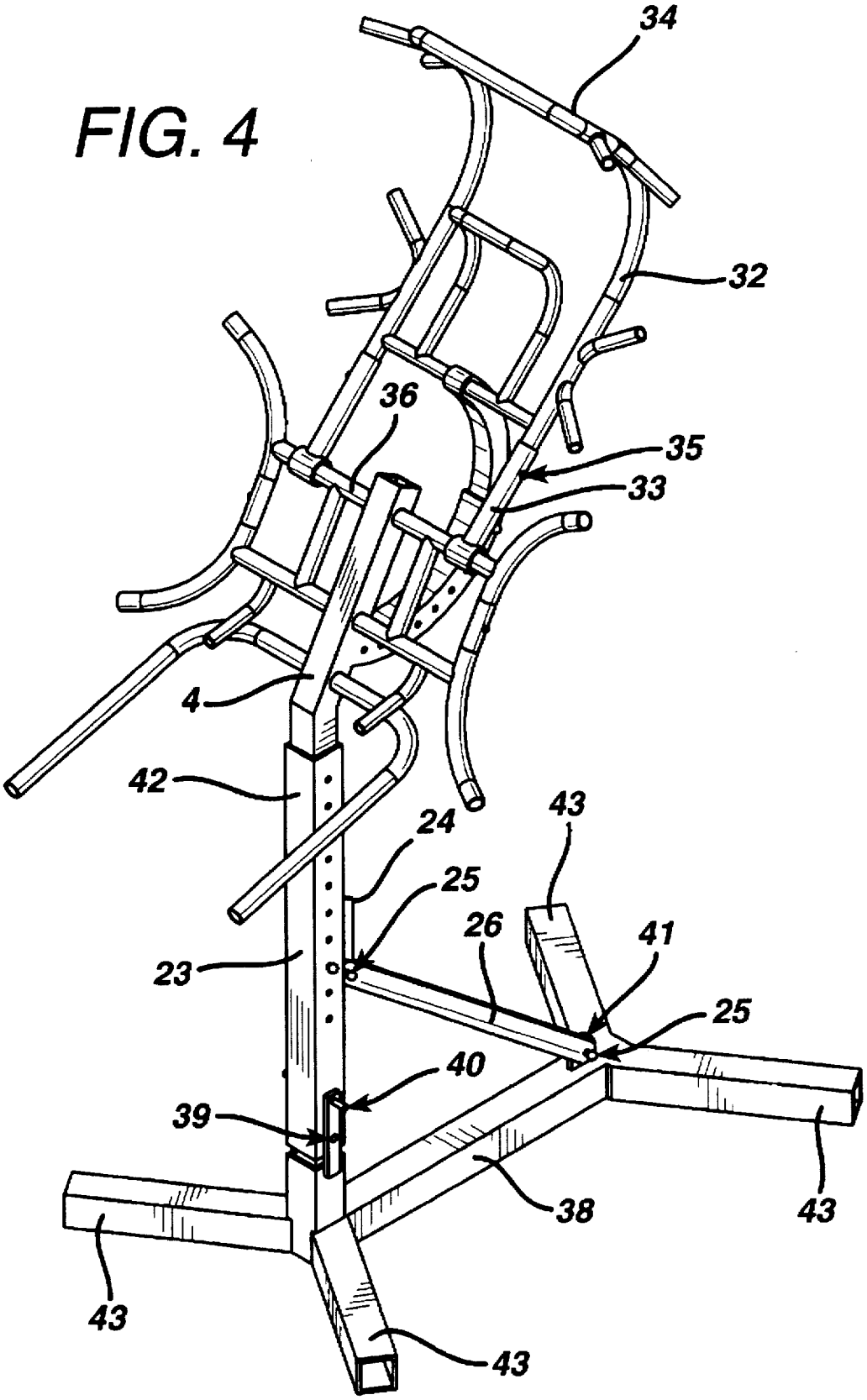
FIG. 4 is a perspective view of another apparatus for physical rehabilitation and athletic training and crosstraining in accordance with this invention.
Figure 5:
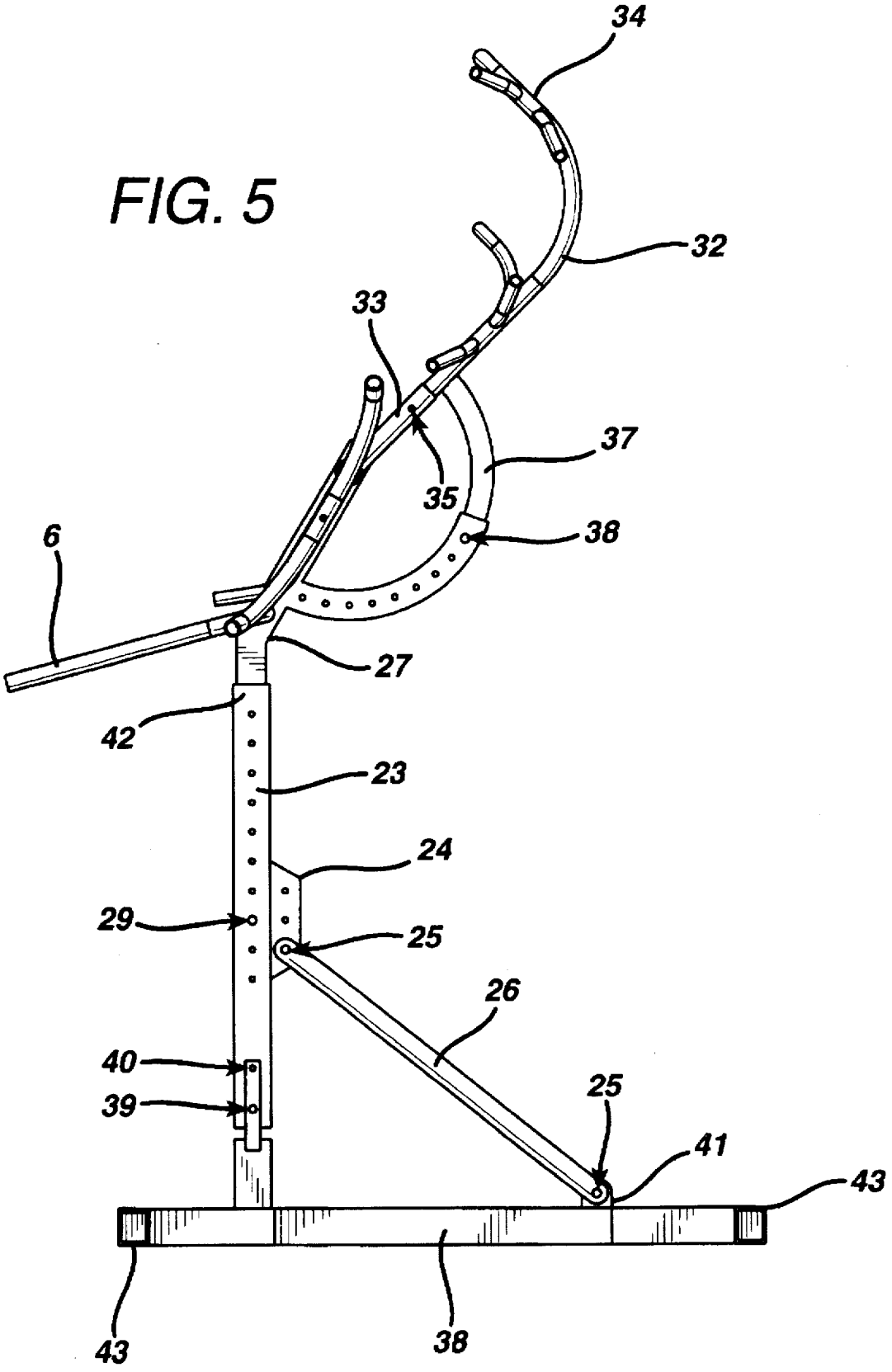
FIG. 5 is a right side elevation view of the apparatus in FIG. 4.
Figure 6:
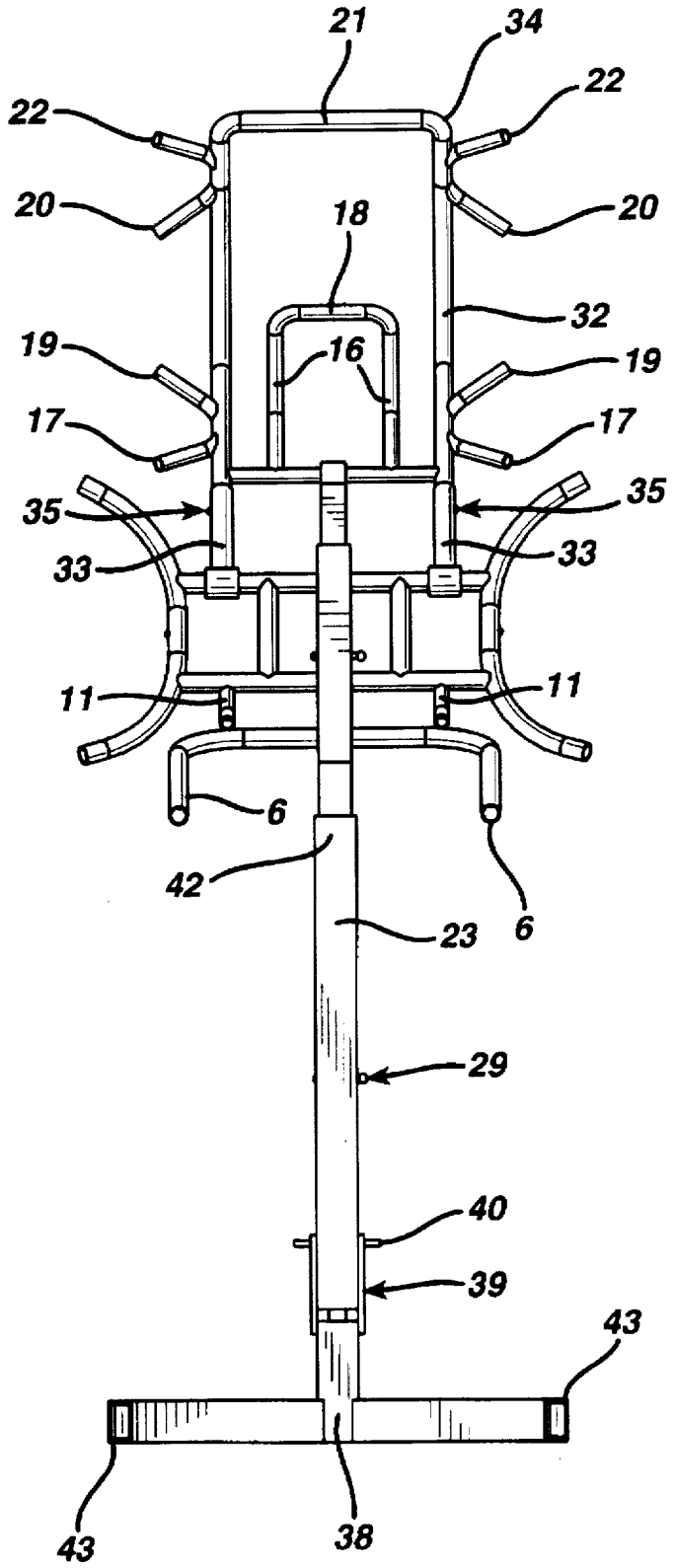
FIG. 6 is a rear elevation view of the apparatus in FIG. 4.

With reference now to the drawings, and in particular to FIGS. 1–6 thereof, a new and novel apparatus and method of use of the apparatus for physical rehabilitation and athletic training and cross-training embodying the principles and concepts of the present invention and generally designated by the reference numeral 10 in FIGS. 1–3 and 42 in FIGS. 4–6 will be described.

Figure 1:
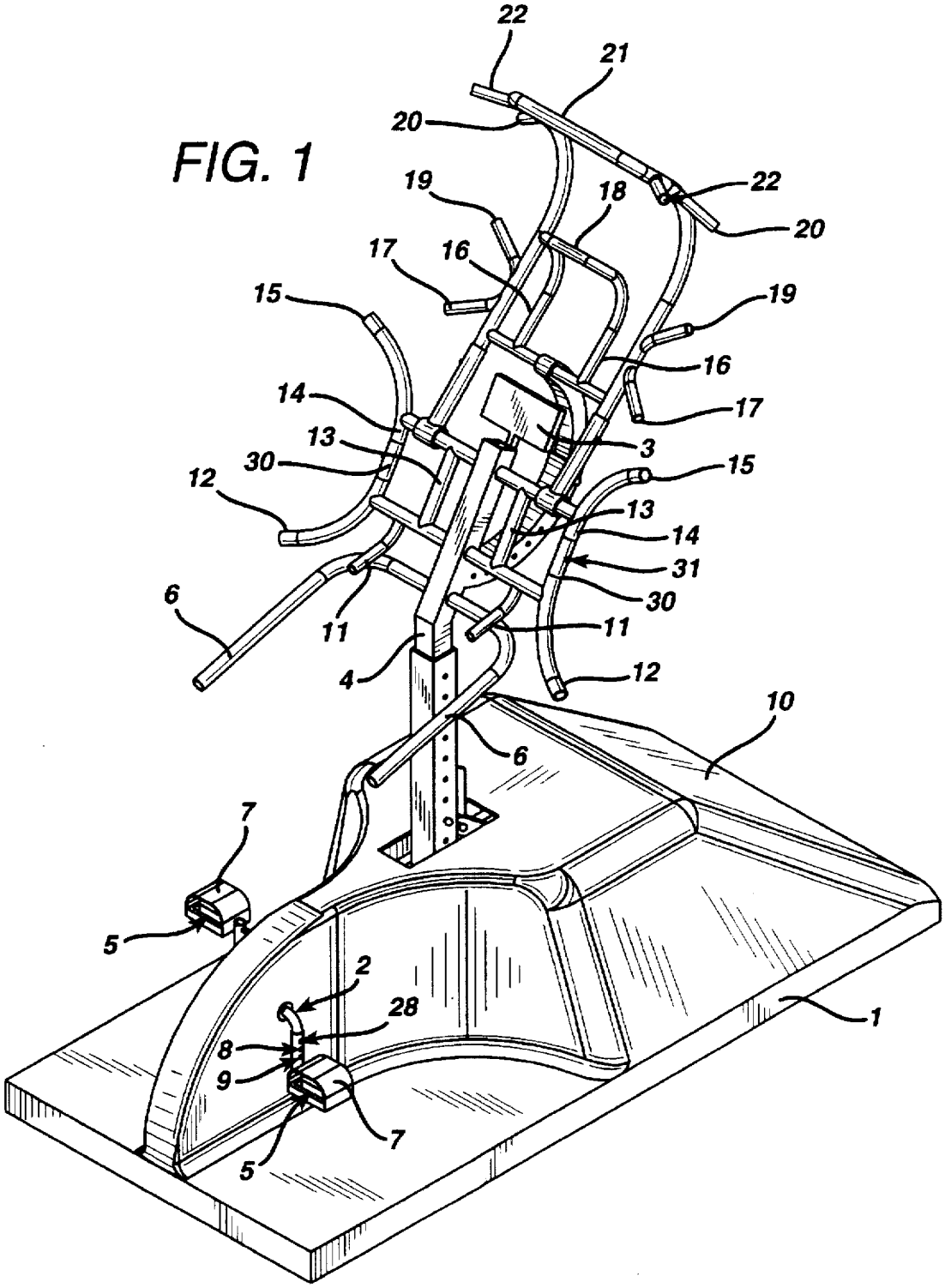
FIG. 1 is a perspective view of a physical rehabilitation and athletic training and crosstraining apparatus embodying the present invention.

FIGS. 1–3 show the most preferred embodiment of an apparatus 10 in accordance with this invention for physical rehabilitation and athletic training and crosstraining. As indicated therein, apparatus 10 comprises four primary components, including a variable resistance cycle ergometer means contained in a stable base 1 made of suitable materials such that the pedal mechanism 2 which is made of suitable materials may be pedaled at a rate of 10 to 70 revolutions per minute, while controlling the resistance thereof with the electronic, voice activated and/or mechanical control means for the resistance of the variable resistance cycle ergometer with informational and control display means 3 and a handhold assembly 4 made of steel or any other suitable material rigidly attached to the variable resistance cycle ergometer means contained in a stable base 1.

The most preferred method of use of this invention would be, prior to using this invention, a person using the apparatus 10 as shown in FIG. 1, FIG. 2 and FIG. 3, would have assessed their general health including cardiopulmonary limitations, and their limitations of motion and stress load of all their muscles and joints. The person using the apparatus 10 would then step onto the pedals 5 from the rear of the apparatus 10 stabilizing themselves by holding onto the handhold position 6 slipping each foot under the toe clip 7 of the corresponding pedal 5. The person would then set the electronic, voice activated and/or mechanical control means for the resistance of the variable resistance cycle ergometer with informational and control display means 3 on its lowest resistance setting and begin pedaling the pedal mechanism 2 slowly to determine if the pedal stroke adjustment 8 permits the person to move the ankle, knee and hip joints and muscles in accordance with their limitations of motion, but maintaining if possible the maximum range of such motion within the limitations.

If the range of motion of the ankle, knee and hip joints and muscles that is set up by pedaling the pedal mechanism 2 is above the limitations of motion of the person, then the range of motion of the ankle, knee and hip joints and muscles may be decreased by shortening the stroke of the pedal arm 9 by use of the pedal stroke adjustment 8 which slides telescopically over the pedal mechanism 2 and which pedal stroke adjustment 8 has a plurality of holes that accepts the spring loaded locking pin 28 that is attached to the pedal mechanism 2 allowing the pedal arm 9 to rigidly engage the pedal mechanism 2 with little or no movement between them as the person causes the pedal mechanism 2 to revolve while pedaling the pedals 5.

Conversely if the range of motion of the ankle, knee and hip joints and muscles that is set up by pedaling the pedal mechanism 2 is below the limitations of motion of the person, then the range of motion of the ankle, knee and hip joints and muscles may be increased by lengthening the stroke of the pedal arm 9 by use of the pedal stroke adjustment 8 which slides telescopically over the pedal mechanism 2 and which pedal stroke adjustment 8 has a plurality of holes that accepts the locking pin 28 that is attached to the pedal mechanism 2 allowing the pedal arm 9 to rigidly engage the pedal mechanism 2 with little or no movement between them as the person causes the pedal mechanism 2 to revolve while pedaling the pedals 5.

Once the pedal stroke adjustment 8 has been set to allow the person the maximum range of motion of the ankle, knee and hip joints and muscles given their limitations of motion, the handhold assembly 4 is then adjusted: 1) telescopically within the main support 23 and held in place by the locking pin 29 in one of the plurality of holes in the main support 23 and handhold support frame 27; 2) pivotally by resetting the removable pivot pin 25 and pivotally attaching the pitch stabilizer 26 to another of the plurality of holes of the adjustment bar 24; and 3) by moving the locking arm 37 of the upper handhold assembly 32 telescopically within the semicircular projection of the handhold support frame 27 and held in place with a locking pin means 38 in one of the plurality of holes in the locking arm 37 and the semicircular projection of handhold support frame 27, all of which adjustments are made to establish the position of the handhold assembly 4 relative to the person using the apparatus 10 such that a person may establish and maintain a full range of vertebral curvatures with full upper body flexion and extension as the arms of the person are circumducted, neutral, internally and externally rotated, flexed and extended, abducted and adducted, isotonically and isometrically, agonistically and antagonistically while the person's hands are holding, in any possible combination thereof, the various handhold positions 6, 11, 12, 13, 14, 15, 16, 17, 18, 19, 20, 21, and 22, while the person is pedaling the variable resistance cycle ergometer means in a stable base 1 at a rate of 10 to 70 revolutions per minute. The handhold positions 6, 11, 12, 13, 14, 15, 16, 17, 18, 19, 20, 21, and 22 optimally will be held by the person using the apparatus 10 in a manner that will permit the person to utilize the joints and muscles of the upper body, including the lower back, within their full range of motion given their respective limitations.

The handhold assembly 4 as shown in FIG. 2 is comprised of a main support 23 made of steel or any other suitable material which is pivotally attached to the variable resistance cycle ergometer means contained in a stable base 1, (pivotal attachment not shown), to which is solidly attached a pitch adjustment bar 24 made of suitable materials in which there are a series of holes that accept a removable pivot pin 25 that pivotally attaches the pitch stabilizer 26 to the pitch adjustment bar 24, and which pitch stabilizer 26 is pivotally attached to the variable resistance cycle ergometer means contained in a stable base 1, (pivotal attachment not shown) at a place that will afford the handhold assembly 4 the maximum stability by mechanical advantage causing the pitch stabilizer 26 to be situated in a position between 30° to 60° at its point of pivotal attachment to the stable base 1 relative to the horizontal plane. As the pitch stabilizer 26 is pivotally attached to the pitch adjustment bar 24 with the removable pivot pin 25 along the series of holes of the pitch adjustment bar 24, the handhold assembly may be adjusted toward and away from the person using the apparatus 10, wherein the main support 23 may be in a vertical position relative to the floor to a position leaning forward away from the person using the apparatus 10 by 15° relative to the base of the main support 23 from the vertical position thereof.

The handhold assembly 4 as shown in FIG. 2 is further comprised of a handhold support frame 27 which fits telescopically in the main support 23 allowing the handhold support frame 27 to be adjusted according to the needs of the person using the apparatus 10. The adjusted position of the handhold support frame 27 being maintained by a locking pin 29 which fits through one or more of the plurality of diametrically opposed holes in the main support 23 through a hole in the handhold support frame 27.

The handhold positions 6, 11, 13, and 14 as shown in FIG. 1, are rigidly attached to the handhold support frame 27 as shown in FIG. 2. FIG. 1 further shows handhold positions 12 and 15 being rotatably adjustable inside of the handhold sleeve 30 and locked into position within one of the plurality of holes on the handhold positions 12 and 15 with a locking pin means 31.

As shown in FIG. 3, an upper handhold assembly 32 is pivotally attached to the handhold support frame 27 and is further comprised of two pivot arms 33 each of which is constructed of two tubular members rigidly attached perpendicular to each other, and through one plane of the pivot arms 33 is inserted pivot tube 36 of the handhold support frame 27, such that the pivot arms 33 revolve around the pivot tube 36, and through the perpendicular plane of the pivot arms 33 the tubular ends of the upper handhold assembly 32 fit telescopically therein and the upper handhold assembly 32 being telescopically adjustable inside the pivot arms 33 and locked into position within one of the plurality of holes on the pivot arms 33 with a locking pin means 35. The upper handhold assembly 32 further comprising a semicircular rigidly attached locking arm 37 that fits telescopically within the semicircular projection of the handhold support frame 27 which allows the upper handhold assembly to rotate toward and away from the person using the apparatus 10 around the axis formed by the pivot tube 36 when the upper handhold assembly 32 is adjusted by moving telescopically the locking arm 37 within the semicircular projection of the handhold support frame 27 and the locking arm 37 is locked into position within one of the plurality of holes on the semicircular projection of the handhold support frame 27 with a locking pin means 38.

The handhold assembly 4 as shown in FIG. 1, FIG. 2 and FIG. 3 is the same as the handhold assembly 4 as shown in FIG. 4, FIG. 5 and FIG. 6. In another preferred embodiment in accordance with this invention for physical rehabilitation and athletic training and crosstraining, the main support 23 of the handhold assembly 4 of the freestanding apparatus 42, as shown in FIG. 4, FIG. 5 and FIG. 6, is pivotally attached to a fork locking means 40 with a lower pivot pin 39. The fork locking means 40 being rigidly attached to a freestanding base 38. The freestanding base 38 is further comprised of a pitch stabilizer attaching means 41 which accepts the pivotal attachment of the pitch stabilizer 26 with a removable pivot pin 25. The handhold assembly 4 as shown in FIG. 4, FIG. 5 and FIG. 6, in identical fashion to the most preferred embodiment of FIG. 2, is comprised of a main support 23 to which is solidly attached a pitch adjustment bar 24 made of suitable materials in which there are a series of holes that accept a removable pivot pin 25 that pivotally attaches the pitch stabilizer 26 to the pitch adjustment bar 24, and which pitch stabilizer 26 is pivotally attached at a place that will afford the handhold assembly 4 the maximum stability by mechanical advantage causing the pitch stabilizer 26 to be situated in a position between 30° to 60° at its point of pivotal attachment to the freestanding base 38 relative to the horizontal plane. As the pitch stabilizer 26 is pivotally attached to the pitch adjustment bar 24 with the removable pivot pin 25 along the series of holes of the pitch adjustment bar 24, the handhold assembly may be adjusted toward and away from the person using the freestanding apparatus 42, wherein the main support 23 may be in a vertical position relative to the floor to a position leaning forward away from the person using the freestanding apparatus 42 by 15° relative to the base of the main support 23 from the vertical position thereof.

The freestanding base 38 is constructed of welded steel, or other suitable material, such that the span of the legs 43 provide the maximum stability of the freestanding apparatus 42 while occupying the least amount of floor space possible to maintain portability.

The fork locking means 40 being designed and constructed of suitable materials to allow the attachment of a wide variety of cycle ergometers which include stationary bikes and portable ergometers that facilitate the use of a bicycle.

Once a cycle ergometer means is attached to the freestanding apparatus 42, the method of use of the freestanding apparatus 42 is identical to the most preferred method of use described above for the use of the most preferred embodiment, the apparatus 10, except that the adjustment of the pedal stroke length described in the method of use of the most preferred embodiment may or may not be available depending upon the cycle ergometer means being used.

In yet another preferred method of use of this invention a cardiac stress test is conducted upon a person using the apparatus 10 as shown in FIG. 1, FIG. 2 and FIG. 3. A properly trained professional assesses the person's general health including cardiopulmonary limitations, and their limitations of motion and stress load of all their muscles and joints. The person being given the cardiac stress test would then step onto the pedals 5 from the rear of the apparatus 10 stabilizing themselves by holding onto the handhold position 6 slipping each foot under the toe clip 7 of the corresponding pedal 5. The trained professional would then set the electronic, voice activated and/or mechanical control means for the resistance of the variable resistance cycle ergometer with informational and control display means 3 on its lowest resistance setting and the person being tested would then begin pedaling the pedal mechanism 2 slowly to permit the trained professional to determine if the pedal stroke adjustment 8 permits the person to move the ankle, knee and hip joints and muscles in accordance with their limitations of motion, while maintaining if possible the maximum range of such motion within the limitations of the person being tested, while at all times the trained professional appropriately monitors the electrocardiogram, blood pressure, heart and respiration rates of the person.

If the range of motion of the ankle, knee and hip joints and muscles that is set up by pedaling the pedal mechanism 2 is above the limitations of motion of the person, then the range of motion of the ankle, knee and hip joints and muscles is decreased by shortening the stroke of the pedal arm 9 by use of the pedal stroke adjustment 8 which slides telescopically over the pedal mechanism 2 and which pedal stroke adjustment 8 has a plurality of holes that accepts the spring loaded locking pin 28 that is attached to the pedal mechanism 2 allowing the pedal arm 9 to rigidly engage the pedal mechanism 2 with little or no movement between them as the person causes the pedal mechanism 2 to revolve while pedaling the pedals 5.

Conversely if the range of motion of the ankle, knee and hip joints and muscles that is set up by pedaling the pedal mechanism 2 is below the limitations of motion of the person, then the range of motion of the ankle, knee and hip joints and muscles is increased by lengthening the stroke of the pedal arm 9 by use of the pedal stroke adjustment 8 which slides telescopically over the pedal mechanism 2 and which pedal stroke adjustment 8 has a plurality of holes that accepts the locking pin 28 that is attached to the pedal mechanism 2 allowing the pedal arm 9 to rigidly engage the pedal mechanism 2 with little or no movement between them as the person causes the pedal mechanism 2 to revolve while pedaling the pedals 5.

Once the pedal stroke adjustment 8 has been set to allow the person being given the cardiac test the maximum range of motion of the ankle, knee and hip joints and muscles given their limitations of motion, the handhold assembly 4 is then adjusted by the trained professional: 1) telescopically within the main support 23 and held in place by the locking pin 29 in one of the plurality of holes in the main support 23 and handhold support frame 27; 2) pivotally by resetting the removable pivot pin 25 and pivotally attaching the pitch stabilizer 26 to another of the plurality of holes of the adjustment bar 24; and 3) by moving the locking arm 37 of the upper handhold assembly 32 telescopically within the semicircular projection of the handhold support frame 27 and held in place with a locking pin means 38 in one of the plurality of holes in the locking arm 37 and the semicircular projection of handhold support frame 27, all of which adjustments are made to establish the position of the handhold assembly 4 relative to the person being given the cardiac test on the apparatus 10 such that a person may establish and maintain a full range of vertebral curvatures with full upper body flexion and extension as the arms of the person are circumducted, neutral, internally and externally rotated, flexed and extended, abducted and adducted, isotonically and isometrically, agonistically and antagonistically while the person's hands are holding, in any possible combination thereof, the various handhold positions 6, 11, 12, 13, 14, 15, 16, 17, 18, 19, 20, 21, and 22, while the person is pedaling the variable resistance cycle ergometer means in a stable base 1 at a rate of 10 to 70 revolutions per minute. The handhold positions 6, 11, 12, 13, 14, 15, 16, 17, 18, 19, 20, 21, and 22 optimally will be held by the person being given the cardiac test on the apparatus 10 in a manner that will permit the person to utilize the joints and muscles of the upper body, including the lower back, within their full range of motion given their respective limitations.

Once the apparatus 10 in FIGS. 1–3 has been adjusted to the person being given the cardiac stress test, the person being tested then begins pedaling the apparatus 10 at a rate of 10–70 revolutions per minute. The trained professional then adjusts the electronic, voice activated and/or mechanical control means for the resistance of the variable resistance cycle ergometer with informational and control display means 3 by gradually increasing the resistance the person is pedaling against and carefully monitoring with appropriate equipment (i.e. a sphygmomanometer, electrocardiograph, echocardiograph, stethoscope, pulse oximeter, and respiration monitor) certain medical factors including the person's electrocardiogram, heart rate, blood pressure and respiration rate as indicated in commonly accepted medical practices for cardiac stress testing and will further adjust the resistance by either increasing or decreasing it according to the monitored medical factors. The trained professional may then cause the person being tested to establish and maintain a full range of vertebral curvatures with full upper body flexion and extension by having the person being tested place their arms such that they are circumducted, neutral, internally and externally rotated, flexed and extended, abducted and adducted, isotonically and isometrically, agonistically and antagonistically while the person's hands are holding, in any possible combination thereof, the various handhold positions 6, 11, 12, 13, 14, 15, 16, 17, 18, 19, 20, 21, and 22, while the person is pedaling the variable resistance cycle ergometer means in a stable base 1.

The trained professional will cause the person being given the cardiac stress test to continue pedaling the apparatus 10, either with or without the use of the handhold apparatus 4, for a period of time that is appropriate under medically accepted practices for monitoring a person for the purpose of conducting a cardiac stress test. Once the cardiac stress test is completed the person being tested will cool down by continuing to pedal the apparatus 10 as the trained professional gradually decreases the resistance of the variable resistance cycle ergometer means in a stable base 1, and continues to monitor the person's electrocardiogram, heart rate, blood pressure and respiration rate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and novel and desired to be protected by Letters Patent of the United States is as follows:

1. An exercise and rehabilitation device comprising:

a frame including a base, an upwardly extending main support and a variable resistance cycle ergometer;

said upwardly extending main support is pivotally attached to said base at a first point and attached via a pitch stabilizer at a second point thereby permitting pitch adjustability of said upwardly extending main support relative to said base;

said upwardly extending main telescopingly receives a handhold assembly, thereby allowing for telescopic adjustment of said handhold assembly;

said handhold assembly comprises a support frame including a semicircular projection and pivot tubes;

said semicircular projection telescopingly receives a semicircular locking arm, wherein said semicircular looking arm is rigidly attached to an upper handhold assembly;

said upper handhold assembly includes pivot arms that are pivotally attached to said handhold assembly support frame via said pivot tubes, thereby permitting pivotal adjustment of said upper handhold assembly relative to said handhold assembly support frame; and said upper handhold assembly and said handhold assembly support frame each having multiple left handholds and multiple right handholds attached thereto such that said multiple left handholds and said multiple right handholds can be positioned at user defined locations upon adjustment of said upwardly extending main support, said handhold assembly support frame and said upper handhold assembly, thereby permitting the placement of a user's body, while the user is holding said multiple left handholds and said multiple right handholds during simultaneous pedaling of said variable resistance cycle ergometer in a standing position, in differing angulations including full hip flexion to full hip extension, further placing the user's upper and lower body musculature and joints in a range of conditions from full flexion to full extension while the user's arms can be neutrally positioned, internally and externally rotated, abducted, adducted and circumducted isotonically, isometrically, agonistically and antagonistically.

2. The new and improved exercise and physical rehabilitation device as described in claim 1 wherein the variable resistance cycle ergometer means further includes an adjustable pedal assembly allowing the adjustment of the pedal stroke.

3. The new and improved exercise and physical rehabilitation device as described in claim 1 wherein the variable resistance cycle ergometer means further includes a voice activated means of adjusting resistance and time of use of the variable resistance cycle ergometer.

4. The new and improved exercise and physical rehabilitation device as described in claim 1 wherein the variable resistance cycle ergometer means further includes an electronically activated means of adjusting resistance and time of use of the variable resistance cycle ergometer.

5. The new and improved exercise and physical rehabilitation device as described in claim 1 wherein the adjustable handhold apparatus further includes an attaching means for attachment of a variety of cycle ergometers which include stationary bikes and portable ergometers that facilitate the use of a bicycle.

6. A method of physical rehabilitation or athletic training or crosstraining utilizing said exercise and rehabilitation device of claim 1 comprising the steps of:

adjusting said upwardly extending main support, said handhold assembly support frame and said upper handhold assembly, such that the placement of a user's body, while the user is holding said multiple left handholds and said multiple rights handholds during simultaneous pedaling of said variable resistance cycle ergometer in a standing position, is in differing angulations including full hip flexion to full hip extension, further placing the user's upper and lower body musculature and joints in a range of conditions from full flexion to full extension while the user's arms can be neutrally positioned, internally and externally rotated, abducted, adducted and circumducted isotonically, isometrically, agonistically and antagonistically; and pedaling said variable resistance cycle ergometer the user is holding said multiple left handholds and said multiple rights handholds during said simultaneous pedaling of said variable resistance cycle ergometer in a standing position, thereby placing the user's body in differing angulations including full hip flexion to full hip extension, further placing the user's upper and lower body musculature and joints in a range of conditions from full flexion to full extension while the user's arms are neutrally positioned, internally and externally rotated, abducted, adducted and circumducted isotonically, isometrically, agonistically and antagonistically.

7. A method of conducting a cardiac stress test utilizing said exercise and rehabilitation device of claim 1 comprising the steps of:

adjusting said upwardly extending main support, said handhold assembly support frame and said upper handhold assembly, such that the placement of a user's body, while the user is holding said multiple left handholds and said multiple rights handholds during simultaneous pedaling of said variable resistance cycle ergometer in a standing position, is in differing angulations including full hip flexion to full hip extension, further placing the user's upper and lower body musculature and joints in a range of conditions from full flexion to full extension while the user's arms can be neutrally positioned, internally and externally rotated, abducted, adducted and circumducted isotonically, isometrically, agonistically and antagonistically;

pedaling said variable resistance cycle ergometer the user is holding said multiple left handholds and said multiple rights handholds during said simultaneous pedaling of said variable resistance cycle ergometer in a standing position, thereby placing the user's body in differing angulations including full hip flexion to full hip extension, further placing the user's upper and lower body musculature and joints in a range of conditions from full flexion to full extension while the user's arms are neutrally positioned, internally and externally rotated, abducted, adducted and circumducted isotonically, isometrically, agonistically and antagonistically; and monitoring the user's heart and respiration rate, blood pressure and electrocardiogram with medical testing means before, during and after the user's pedaling of said variable resistance cycle ergometer.

* * * * *